US005640859A

United States Patent [19]

Fromm

[11] Patent Number: 5,640,859

[45] Date of Patent: Jun. 24, 1997

[54] TIE-DYEING KIT

[76] Inventor: Wayne G. Fromm, 3500 Bathurst Street, Toronto, Ontario, Canada, M6A 2C6

[21] Appl. No.: 590,767

[22] Filed: Jan. 24, 1996

[51] Int. Cl.[6] ..... B65D 81/36; D06B 11/00

[52] U.S. Cl. ..... 68/213; 8/482; 206/575

[58] Field of Search ..... 8/148, 149, 150, 8/482; 68/213, 235 R; 206/568, 575, 578; 28/163, 164

[56] References Cited

U.S. PATENT DOCUMENTS

| | | | |
|---|---|---|---|
| 1,935,353 | 11/1933 | Coventry . | |
| 3,644,969 | 2/1972 | Guillermin et al. . | |
| 3,840,113 | 10/1974 | Bartleson | 206/575 |
| 3,975,151 | 8/1976 | Berg et al. . | |
| 4,951,483 | 8/1990 | van Olphen | 68/213 |
| 5,032,102 | 7/1991 | Davidson et al. . | |
| 5,228,858 | 7/1993 | Fromm . | |
| 5,279,859 | 1/1994 | May . | |
| 5,435,240 | 7/1995 | Fromm . | |

FOREIGN PATENT DOCUMENTS

| | | | |
|---|---|---|---|
| 0059965 | 4/1984 | Japan | 8/482 |

OTHER PUBLICATIONS

*Redbook*, vol. 135, No. 2, "A Little Guide to Tie–Dyeing " Cover page and pp. 6, 81, 172, 174, & 176, Jun. 1970.

*School Arts*, vol. 68, No. 9, "We Tied and Dyed" Contents page & pp. 18–19, May 1969.

*Marketing*, "Profit Hint: Always Say Dye" p. 71, Jan. 1970.

Tyco, "Doodle Bear" Instruction sheet; ©1994.

Mattel, "Barbie Tie & Dye" Instruction sheets, ©1993.

*Primary Examiner*—Philip R. Coe

*Attorney, Agent, or Firm*—John C. Thompson

[57] ABSTRACT

A composite, ready-to-use, do-it-yourself tie-dyeing kit (10) for producing a washable dyed pattern on an article of clothing (14) so that the user of the kit may learn the art and craft of tie-dyeing without ruining or consuming articles of clothing or fabric in the process and will be able to create designs and redo until satisfied with the results. The kit includes instructions (22), and a plurality of containers (18), each of which contains a liquid washable non-toxic dye (19), which dyes may dye a fabric at room temperature, and which washable dyes may be substantially completely washed out of the fabric by the user. The tie-dyeing kit further includes one or more ready-to-dye fabric garments (14) to which the washable dyes will adhere until the garment is washed out, and a device (20) for tying the garment while it is being dyed. The tying device is preferably a twist tie (20.1) or a clip (20.2). A child's toy such as a teddy bear (12) is preferably included in the kit, the garments being of a size which may be worn by the teddy bear.

12 Claims, 3 Drawing Sheets

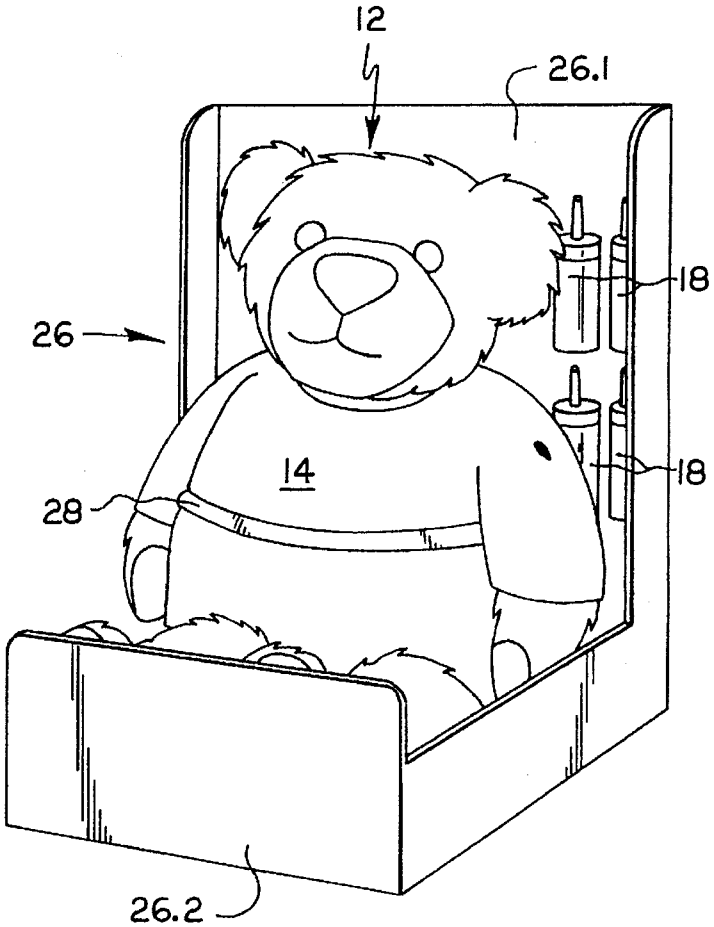
FIG. 2
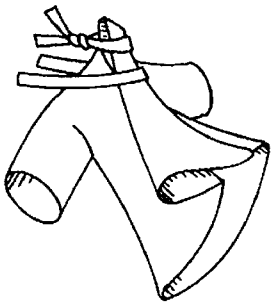
FIG. 4
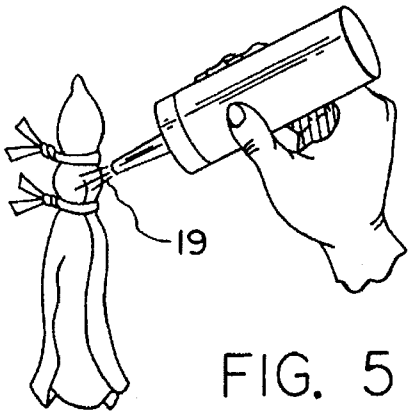
FIG. 5
FIG. 3
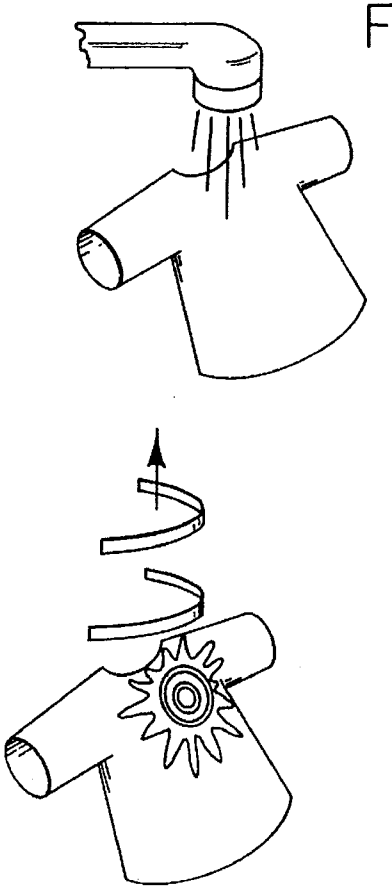
FIG. 6

TIE-DYEING KIT

TECHNICAL FIELD

The present invention relates generally to a kit which may be used for educational purposes, and more particularly to a kit especially designed for teaching the art and craft of tie-dyeing, the kit including instructions on the art of tie-dyeing, a toy such as a teddy bear, one or more ready-to-dye garments which may be worn by the teddy bear, a plurality of containers, each of which contains a liquid washable dye suitable for immediate use, tying devices such as twist ties, pipe cleaners, rubber bands, and/or clips which may be used for tying the garments, and stencils so that additional art work may be added to the garment after tie-dyeing.

BACKGROUND OF THE INVENTION

Tie-dyeing is a method of dyeing by hand in which patterns are produced in a fabric by gathering together one or more portions of the fabric and tying them tightly together. Typically, after the fabric has been suitably tied, it is then immersed, either partially or completely, in a dye bath. The dye will fail to penetrate the tied sections, and after dyeing, the fabric is untied to reveal interesting irregular patterns. Varicolored patterns may be produced by repeated tying and dyeing with additional colors. This hand dyeing method is common in India, Indonesia, and West Africa, and became popularized in the U.S. in the late 1960's as part of a trend away from conformity. Since the 60's, tie-dyed garments have become part of the American culture. However, prior to the present invention, all kits suitable for use in tie-dyeing, such as the one shown in U.S. Pat. No. 4,951,483, utilized permanent dyes. This has the disadvantage, particularly for a beginners to the art, in that they do not have the opportunity of reusing the tie-dyed garment or fabric if they are not satisfied with the result.

OBJECTS AND SUMMARY OF THE INVENTION

It is an object of the present invention to provide a tie-dyeing kit for producing washable dyed patterns on articles of clothing so that the user of the kit may learn the art and craft of tie-dyeing without ruining or consuming articles of clothing or fabric in the process and will be able to create designs and redo them until satisfied with the results.

More particularly, it is an object of the present invention to provide a kit for the foregoing object, wherein the kit contains a ready-to-dye fabric garment, a plurality of containers each of which contains a washable nontoxic dye which may be used at room temperature, and which washable dyes may be substantially completely washed out of the fabric garment by the user.

It is a further object of the present invention to provide a kit of the type set forth above wherein devices are provided for tying the garment while it is being dyed, which devices include twist ties, pipe cleaners, rubber bands and/or clips.

It is a further object of the present invention to provide within the kit of the type set forth above a doll or teddy bear to facilitate the marketability of the kit, the fabric garment being of a size that it may be worn by the doll or teddy bear.

The foregoing objects and other objects and advantages of this invention will become more apparent after a consideration of the following detailed description taken in conjunction with the accompanying drawings in which a preferred form of this invention is illustrated.

BRIEF DESCRIPTION OF THE DRAWINGS

FIG. 2 is a perspective view of a prototype package which incorporates the tie-dyeing kit of this invention.

FIGS. 3–6 illustrate various steps of the process of using the kit of this invention, FIG. 3 illustrates the initial step of wetting or washing the garment, FIG. 4 illustrating the step of tying the garment with a twist tie prior to dyeing, FIG. 5 illustrating the step of dyeing the garment, and FIG. 6 illustrating the step of removing the twist tie from the garment and unfolding the garment so that the dye pattern may be inspected.

DETAILED DESCRIPTION

Figure 1:
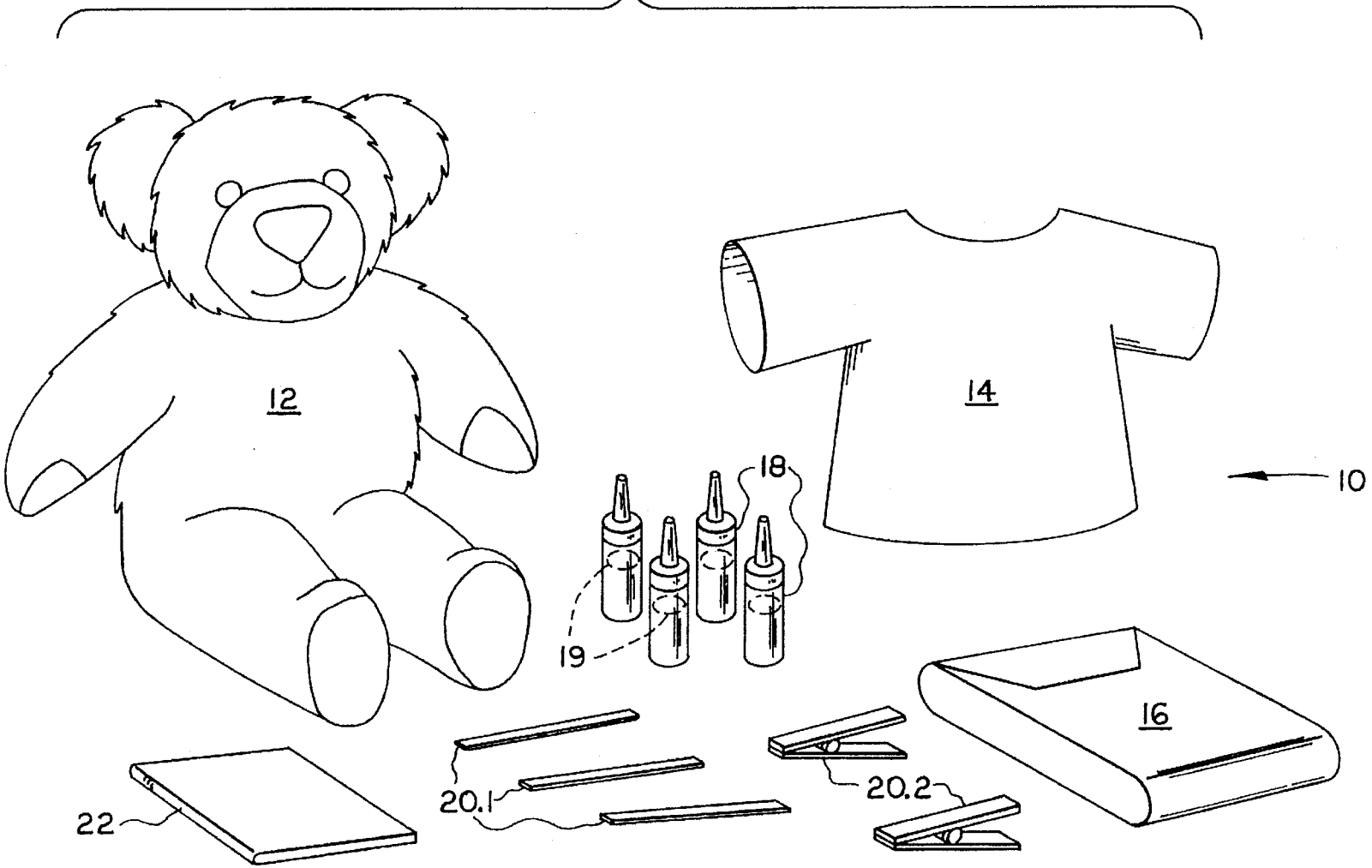
FIG. 1 is an illustration which shows the various components of the tie-dyeing kit of this invention.

With reference initially to FIGS. 1 and 2, the kit of this invention is indicated generally at 10. In the preferred embodiment the kit includes as its principal components a child's toy in the form of a teddy bear 12. While the preferred toy illustrated is a teddy bear, it may be a doll or other toy animal. The kit also includes one or more articles of clothing (or garments) which may be worn by the toy. One illustrated garment is a T-shirt 14. Other articles of clothing may include a hat, shorts, a bandanna, a sleeper, pajamas, overalls, and a dress, these other articles of clothing being represented by the package 16. The tie-dyeing kit also includes a plurality of containers 18, each container being provided with a suitable dye 19. Thus, for example, one of the containers may be provided with a blue dye, another with a yellow dye, and a third with a red dye so that various colors can be created from these three primary colors. In addition, a fourth container may be provided with a black dye. Each of these dyes is a washable liquid nontoxic dye suitable for immediate use. However, if desired, dry dyes similar to those sold for coloring Easter eggs may be provided. If dry dyes are provided they would have to be prepared in a suitable manner before use.) The containers are preferably plastic squeeze bottles similar to those sold in craft stores for fabric paints. An empty spray bottle, not shown, may also be included to facilitate stencilling. Means for tying the garment 14 while it is being dyed are also provided, these means being in the form devices such as twist ties 20.1, or clips 20.2. While not shown, pipe cleaners and/or rubber bands may also be included in the tie-dyeing kit of this invention, the pipe cleaners being of the common type which are used for cleaning the stems of smoking pipes. Finally, stencils and a booklet of instructions 22 may also be provided, the stencils being useful for adding additional art work to the garment after it has been tie-dyed.

It is a principal feature of this invention that the dye provided within the containers 18 be a washable nontoxic dye. The dye is preferably selected so that it may dye a fabric at room temperature. The dye is also selected so that it can be washed substantially completely out of the fabric garment by either normal hand washing or by a machine wash in a home laundry machine. Thus, it is a feature of this invention that the user of the tie-dyeing kit may learn the art and craft of tie-dyeing without ruining or consuming articles of clothing in the process and will be able to create designs and redo designs on the same fabric garment until they are satisfied with the results. The dyes are selected so that they will not fade under normal conditions of use. Thus, the tie-dyed pattern will remain as long as it is not washed out. However, the dyes may be fixed on the garment with a salt solution.

As can be seen from FIG. 2, the tie-dyeing kit is more or less conventionally packaged in a display box, indicated generally at 26, with the teddy bear being strapped to the back 26.1 of the box by a strap 28 in a conventional manner. The bear will be displayed wearing an undyed article of clothing 14 made of a ready-to-dye fabric. In this regard, it should be noted that many fabrics are coated with a sizing and that prior to dyeing it is necessary to remove the sizing. However, the clothing provided with this kit will be ready for dyeing without pretreatment other than wetting of the fabric as shown in FIG. 3. The containers 18 will also be mounted on the back 26.1 of the packaging by blister packaging, not shown. The bottom 26.2 of the packaging will be an enclosed box-like structure and will contain the other components of the kit such as the tying means 20, additional clothing 16, and the stencils and instruction booklet 22.

Figure 8:
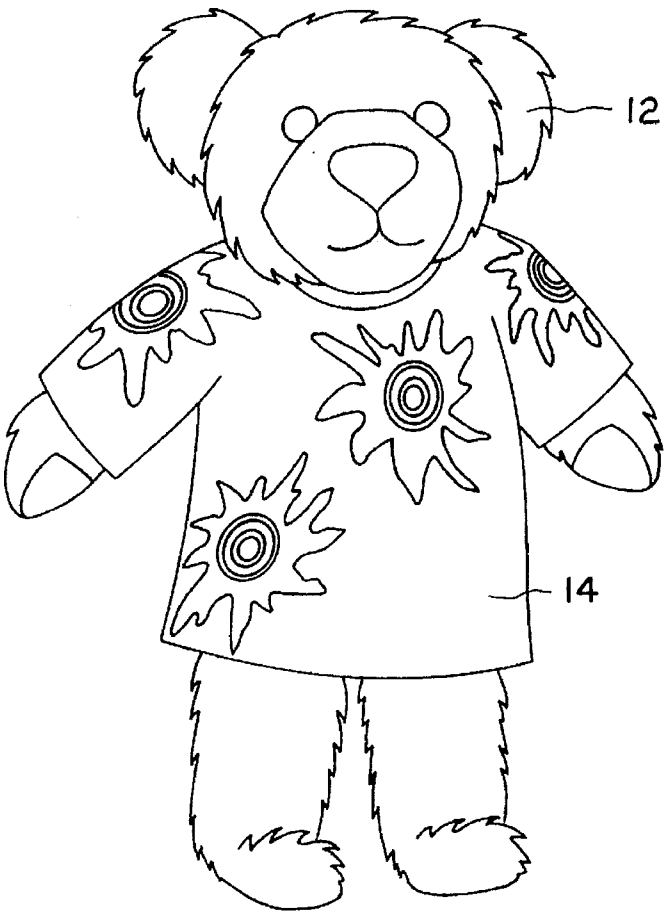
FIG. 8 illustrates an alternative design made by repeated tie-dyeings of the same garment but at differing locations.
Figure 7:
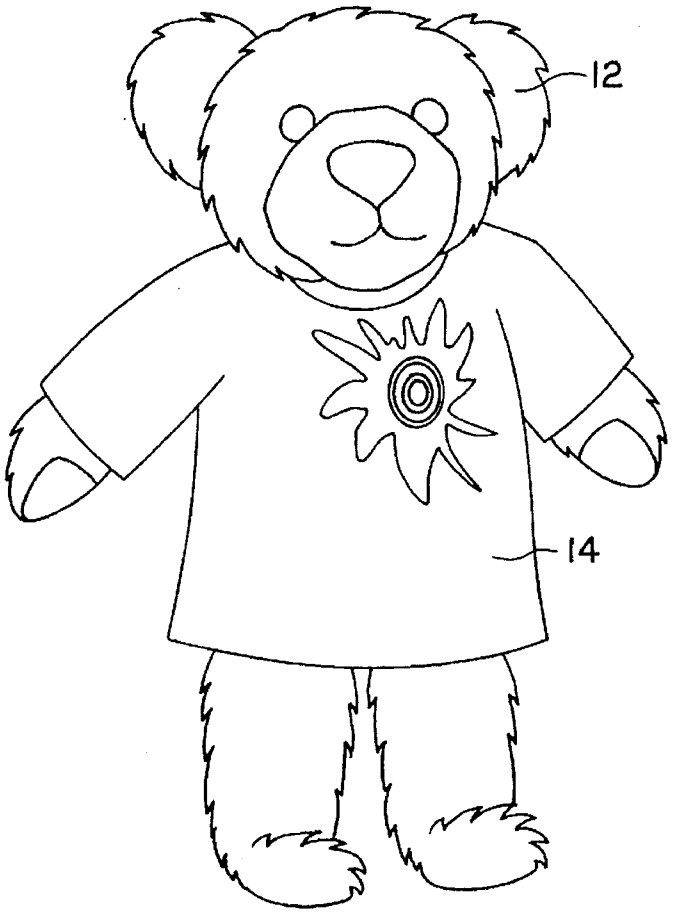
FIG. 7 illustrates the tie-dyed garment made by the steps illustrated in FIGS. 3–6, the garment having been dried and placed upon a teddy bear.

The kit of this invention may be used in many differing ways. One way of using the kit is as follows: Initially the garment will be removed from the teddy bear and if it has not been dyed, it will only be necessary to dampen the outfit with water prior to use. Thus, as can be seen from FIG. 3, the outfit may simply be placed under running water until it is wet, the excess water being squeezed out over a sink. It is not essential that the garment be wet before dyeing. However, the density and flow of the colored dye is different if the fabric is damp, and dampening the fabric allows the color to flow more smoothly than if the garment were dry. However, a tie-dyed pattern may still be created even if the garment is dry. Next, a finger is used to make a point in the garment, at which time one or more tying devices such as twist ties may be twisted onto the garment, with spacing between the ties. The user would then take the bottles of washable dyes, one at a time, and run the tip of each bottle over the sides of the tied outfit. Individual colors can be applied in strip sections, and white spaces can be left between the colors if desired. After the dyeing has been completed, the tie(s) will be undone, and tie-dyed design will be inspected. If the user likes the design the outfit is then dried before putting it on the teddy bear. To dry, the garment is preferably laid flat or it is hung up until dry. If one is not satisfied with the pattern, it will be necessary to wash out the dye. When the dye is wet, it may be washed out in a bathroom or kitchen sink. However, if dry, best results have been found by washing the dyed garment separately from other garments in a hot wash cycle of a home washing machine. After washing, the garment should be laid flat or hung until dry to prevent shrinkage. It is best to use the dye where it is not likely to come into contact with wall paper, matte finish paint, unfinished wood, vinyl carpet, or other materials that cannot be laundered. In FIG. 7 a teddy bear is shown wearing a T-shirt which has been tie-dyed at one location only. In FIG. 8 a teddy bear is shown wearing a T-shirt which has been tie-dyed at a plurality of locations. It should be obvious that many differing designs could be achieved using the kit of this invention.

While one way of using the kit of this invention has been set forth above, it should be apparent that it could be used in other manners. Thus, the garment could be rubber banded, clipped, or tied in any other suitable manner. In addition, the dies may be applied to the garment in a manner different from that described above. For example, a stencil may be placed between the container and the tie-dyed garment and a dye may be sprayed unto and through the stencil to add additional decorations to the tie-dyed garment. Additionally, other dyeing techniques than that set forth above may be utilized.

While a preferred form of this invention has been described above and shown in the accompanying drawings, it should be understood that applicant does not intend to be limited to the particular details described above and illustrated in the accompanying drawings, but intends to be limited only to the scope of the invention as defined by the following claims.

What is claimed is:

1. A composite, ready-to-use, do-it-yourself tie-dyeing kit for producing a washable dyed pattern on an article of clothing so that the user of the kit may learn the art and craft of tie-dyeing without ruining or consuming articles of clothing or fabric in the process and will be able to create designs and redo until satisfied with the results; the kit comprising:

a plurality of containers;

a washable nontoxic dye in each of the plurality of containers, each of which dyes may dye a fabric at room temperature and may be substantially completely washed out of the fabric by the user;

a ready-to-dye fabric garment to which the washable dyes will adhere until the garment is washed out; and means for tying the garment while it is being dyed.

2. The composite, ready-to-use, do-it-yourself tie-dyeing kit as set forth in claim 1 wherein the means for tying the garment is a twist tie.

3. The composite, ready-to-use, do-it-yourself tie-dyeing kit as set forth in claim 1 wherein the means for tying the garment is a clip.

4. The composite, ready-to-use, do-it-yourself tie-dyeing kit as set forth in claim 1 wherein the garment is a small size suitable for a child's toy.

5. The composite, ready-to-use, do-it-yourself tie-dyeing kit as set forth in claim 1 wherein the kit further includes a child's toy.

6. The composite, ready-to-use, do-it-yourself tie-dyeing kit as set forth in claim 5 wherein the child's toy is a teddy bear or other toy animal.

7. The composite, ready-to-use, do-it-yourself tie-dyeing kit as set forth in claim 1 wherein the dye is a liquid suitable for immediate use.

8. The composite, ready-to-use, do-it-yourself tie-dyeing kit as set forth in claim 1 wherein the kit further includes instructions on tie-dyeing.

9. The composite, ready-to-use, do-it-yourself tie-dyeing kit as set forth in claim 1 wherein the kit further includes stencils so that additional art work may be added to the garment after tie-dyeing.

10. The composite, ready-to-use, do-it-yourself tie-dyeing kit as set forth in claim 9 wherein the container has a spray pump so that the dye may be sprayed onto the fabric through a stencil.

11. A composite, ready-to-use, do-it-yourself tie-dyeing kit for producing a washable dyed pattern on an article of clothing so that the user of the kit may learn the art and craft of tie-dyeing without ruining or consuming articles of clothing in the process and will be able to create designs and redo until satisfied with the results; the kit comprising:

a teddy bear or other toy animal;

a ready-to-dye fabric garment for a teddy bear;

a plurality of containers;

a washable liquid nontoxic dye suitable for immediate use in each of the containers, which washable dyes may dye the ready-to-dye garment at room temperature, and which washable dye may be substantially completely washed out of the fabric by the user; and means for tying the garment while it is being dyed.

12. The composite, ready-to-use, do-it-yourself tie-dyeing kit as set forth in claim 11 wherein the means for tying the garment is a twist tie.

* * * * *

US005640859B1

(12) REEXAMINATION CERTIFICATE (4492nd)

United States Patent

Fromm

(10) Number: US 5,640,859 C1

(45) Certificate Issued: Nov. 27, 2001

(54) TIE-DYEING KIT

(75) Inventor: Wayne G. Fromm, 3500 Bathurst Street, Toronto, Ontario (CA), M6A 2C6

(73) Assignee: Wayne G. Fromm, Toronto (CA)

Reexamination Request:
No. 90/005,921, Feb. 2, 2001

Reexamination Certificate for:

| | |
|---|---|
| Patent No.: | **5,640,859** |
| Issued: | **Jun. 24, 1997** |
| Appl. No.: | **08/590,767** |
| Filed: | **Jan. 24, 1996** |

(51) Int. Cl.[7] ..... D65D 81/36; D06B 11/00

(52) U.S. Cl. ..... 68/213; 8/482; 206/575

(58) Field of Search ..... 8/148, 149, 150, 8/482; 68/213, 235 R; 28/163, 164; 206/568, 575, 578

(56) References Cited

U.S. PATENT DOCUMENTS 3,663,262 5/1972 Cogan .

OTHER PUBLICATIONS

Veronica Murphy and Rosemary Crill, Tie–Dyed Textiles of India, 1991, Rizzoli, pp. 72–73, 196–197, and 199.

Jack Lenor Larson, The Dyer's Art: Ikhat, Batik, Plangi, 1976, VanNostrand Rheinhold, pp. 13, 40, and 57.

Anne Maile, Tie–Dyed Paper, 1975, Taplinger Publishing Company, pp. 85–87.

Deborah M. Dryden, Fabric Painting and Dyeing for the Theatre, 1981, Drama Book specialists, pp. 39–40, 62, 68, 69–70, 87, 88, 89, 168–169, Glossary.

"Indian Cottons Adding New Yarn–Dyes, Blends," Daily News Record, May 30, 1991, vol. 21, No. 105, p 2.

"Summer Fun Games: Tie–Dyed Flowers," Parents Magazine, vol. 70, No. 6, p 12, Jun., 1995.

The Gazette (Montreal), Jun. 22, 1995, Final Edition, Living Section, Home, p. D2.

*Primary Examiner*—Frankie L. Stinson

(57) ABSTRACT

A composite, ready-to-use, do-it-yourself tie-dyeing kit (10) for producing a washable dyed pattern on an article of clothing (14) so that the user of the kit may learn the art and craft of tie-dyeing without ruining or consuming articles of clothing or fabric in the process and will be able to create designs and redo until satisfied with the results. The kit includes instructions (22), and a plurality of containers (18), each of which contains a liquid washable non-toxic dye (19), which dyes may dye a fabric at room temperature, and which washable dyes may be substantially completely washed out of the fabric by the user. The tie-dyeing kit further includes one or more ready-to-dye fabric garments (14) to which the washable dyes will adhere until the garment is washed out, and a device (20) for tying the garment while it is being dyed. The tying device is preferably a twist tie (20.1) or a clip (20.2). A child's toy such as a teddy bear (12) is preferably included in the kit, the garments being of a size which may be worn by the teddy bear.

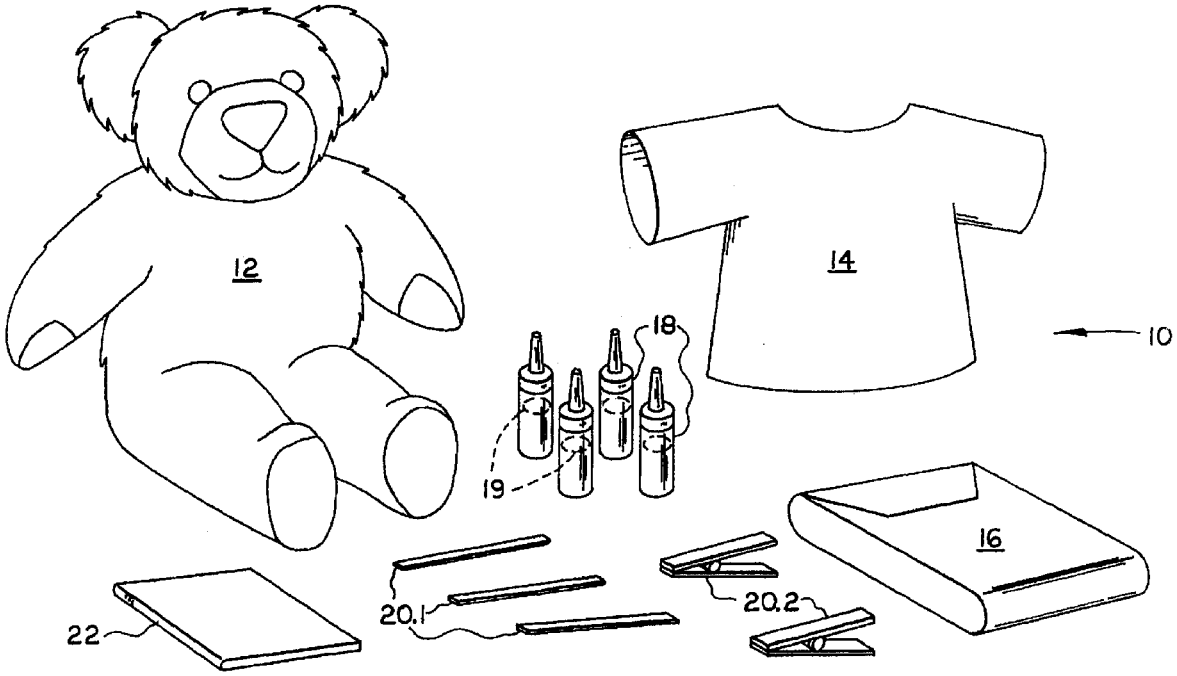

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *

US005640859C2

(12) EX PARTE REEXAMINATION CERTIFICATE (6980th)

United States Patent
Fromm

(10) Number: US 5,640,859 C2
(45) Certificate Issued: Aug. 4, 2009

(54) TIE-DYEING KIT

(76) Inventor: Wayne G. Fromm, 3500 Bathurst Street, Toronto, Ontario (CA), M6A 2C6

Reexamination Request:
No. 90/006,546, Feb. 12, 2003
No. 90/007,236, Oct. 6, 2004

Reexamination Certificate for:

| | |
|---|---|
| Patent No.: | **5,640,859** |
| Issued: | **Jun. 24, 1997** |
| Appl. No.: | **08/590,767** |
| Filed: | **Jan. 24, 1996** |

Reexamination Certificate C1 5,640,859 issued Nov. 27, 2001

(51) Int. Cl.
*D06B 11/00* (2006.01)

(52) U.S. Cl. ..... 68/213; 8/482; 206/575
(58) Field of Classification Search ..... 68/213; 8/482; 206/575
See application file for complete search history.

(56) References Cited

U.S. PATENT DOCUMENTS 4,951,483 A 8/1990 Van Olphen
4,981,516 A 1/1991 Kluger

OTHER PUBLICATIONS

Marked copies of the Mattel Barbie brochures.*
Summons & Complaint for Patent Infringement, Dec. 31, 2002.
Answer and Counterclaims Of Defendant Mattel, Inc., Jan. 24, 2003.
Plaintiff Fromm's Reply to Defendant's Counterclaims, Feb. 5, 2003.
Stipulation Stating That Action Will Be Held In Abeyance, Feb. 26, 2003.
Advertisement for Schilling/McCormick Food Colors & Egg Dye, *Sunset Magazine*, (Mar. 1961), front cover and advertisement page.
Anne Maile, *Tie–and–Dye as a Present–Day Craft*, (Mills & Boon Limited, 1963), front cover and overleaf, pp. 5, 12–17, 164–177.
Carl E. Frankson and Kenneth R. Benson, *Craft Activities Featuring 65 Holiday Ideas*, (Parker Publishing, 1970), front cover and overleaf, pp. 11–17, 113.
Redbook, vol. 135, No. 2, "A Little Guide to Tie–Dyeing" (Jun. 1970), cover page and pp. 6, 81, 172, 174, 176.
Dona Z. Meilach, *Contemporary Batik and Tie–Dye*, (Crown Publishers, 1973), front cover and overleaf, pp. 106–7, 179–180, 200, 250–266.
Anne Maile, *Tie–Dyed Paper*, (Taplinger Publishing Company, 1975), front cover and overleaf, pp. 12–14, 85.
Earl W. Linderman, *Arts and Crafts for the classroom*, (Macmillan Publishing , 1977), front cover and overleaf, pp. 190–199.

(Continued)

*Primary Examiner*—Frankie L Stinson

(57) ABSTRACT

A composite, ready-to-use, do-it-yourself tie-dyeing kit (10) for producing a washable dyed pattern on an article of clothing (14) so that the user of the kit may learn the art and craft of tie-dyeing without ruining or consuming articles of clothing or fabric in the process and will be able to create designs and redo until satisfied with the results. The kit includes instructions (22), and a plurality of containers (18), each of which contains a liquid washable non-toxic dye (19), which dyes may dye a fabric at room temperature, and which washable dyes may be substantially completely washed out of the fabric by the user. The tie-dyeing kit further includes one or more ready-to-dye fabric garments (14) to which the washable dyes will adhere until the garment is washed out, and a device (20) for tying the garment while it is being dyed. The tying device is preferably a twist tie (20.1) or a clip (20.2). A child's toy such as a teddy bear (12) is preferably included in the kit, the garments being of a size which may be worn by the teddy bear.

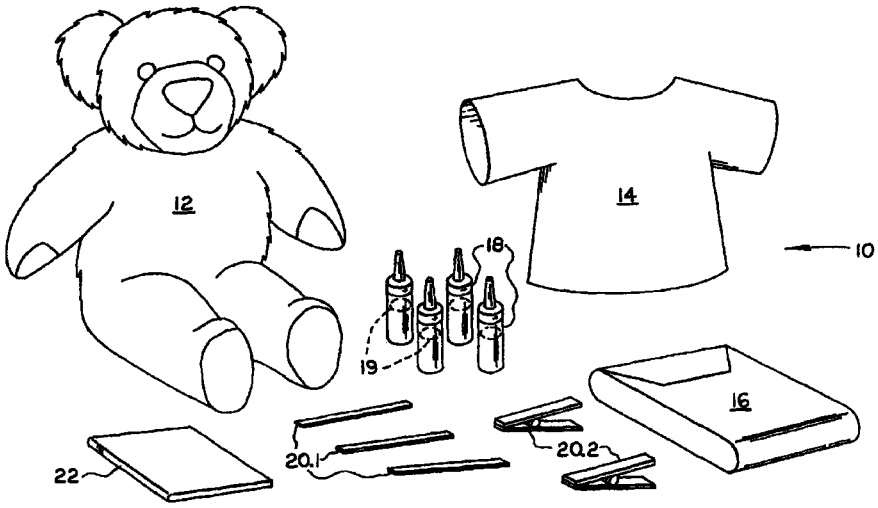

OTHER PUBLICATIONS

Ruth Diez et al., *Stain Removal for Washable Fabrics*, (University of Wisconsin Cooperative Extension Service, 1979), pp. 1–13.

Deborah M. Dryden, *Fabric Printing and Dyeing for the Theatre*, (Drama Book Specialists, 1981), front cover, overleaf and frontispiece, pp. 32, 39–40, 62, 68–70, 87–89.

Richard M. Proctor and Jennifer F. Lew, *Surface Design for Fabric*, (University of Washington Press, 1984), front cover and overleaf, pp. 25, 28–29, 33, 53, 59–61, 72, 88, 99–101, 106, 115, 131, 133–134, 159, back cover.

Spearhead "Dazzlin' Color" egg dye packaging (1989).

Deanna M. Munson, *Spot & Stain Removal for Washable Fabrics*, (Kansas State University Cooperative Extension Service, 1991), front cover, pp. 1–12, back cover.

Veronica Murphy and Rosemary Crill, *Tie–dyed Textiles of India*, (Rizzoli, 1991), front cover and overleaf, pp. 67, 72–73, 196–197, 199.

Mattel, packaging accompanying "Barbie® Tie & Dye™ Fashions" (1993).

Ernestine Porter, *Stain Removal Guide for Washable Fabrics*, (University of Idaho Cooperative Extension System, 1993), pp. 1–15, back cover.

Mattel, "Barbie Tie & Dye" Instruction sheets (1993).

Mattel, catalog page showing "Tie & Dye™ Barbie® Fashions" (1994), p. 44.

Tyco, "Doodle Bear" Instruction sheet (1994).

*The Gazette* (*Montreal*), Jun. 22, 1995, Final Edition, Living Section, Home, p. D2.

Tyco Activity Toys Fashion Place from a Tyco Toys catalog (copyright 1990).

Mattel Toys, "Barbie Tie & Dye™ Instructions" (copyright 1993).

Mattel Toys, packaging accompanying "Barbie® Tie & Dye™ Fashions" (copyright 1993).

Mattel Toys, catalog page showing "Barbie® Tie & Dye™ Fashions" p. 44 (copyright 1994).

U.S. Trademark Registration No. 1922987 for the mark Color Me Kente Kenya, which issued from an application filed on Mar. 28, 1994.

Tyco Dolls Color Me Kente Kenya, from a Tyco Toys catalog and price list, "Effective Nov. 1, 1994" (copyright 1994).

Tyco Toys, "Doodle Bear" Instruction sheet (copyright 1994).

"Tyco Tie Dye Deluxe Bear" and "Tyco Doodle Bear Feature," documents from 1994, as submitted with a declaration of the patentee, Wayne G. Fromm, on Jul. 26, 2004, in Reexamination Control. No. 90/006,546.

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 9 and 10 is confirmed.

Claims 1–8, 11 and 12 are cancelled.

* * * * *